US010782725B2

(12) United States Patent
Stenzel et al.

(10) Patent No.: US 10,782,725 B2
(45) Date of Patent: Sep. 22, 2020

(54) ACTUATING DRIVE WITH OPERATOR CONTROL DEVICE, AND ASSOCIATED METHOD FOR OPERATOR CONTROL

(71) Applicant: AUMA Riester GmbH & Co. KG, Mullheim (DE)

(72) Inventors: Rudiger Stenzel, Hilchenbach (DE); Maik Niklas, Wenden (DE); Dominik Stahl, Wenden (DE)

(73) Assignee: Auma Riester GmbH & Co. KG, Müllheim (DE)

( * ) Notice: Subject to any disclaimer, the term of this patent is extended or adjusted under 35 U.S.C. 154(b) by 0 days.

(21) Appl. No.: 15/975,042

(22) Filed: May 9, 2018

(65) Prior Publication Data

US 2018/0329445 A1 Nov. 15, 2018

(30) Foreign Application Priority Data

May 9, 2017 (DE) ..... 10 2017 110 009

(51) Int. Cl.
*G05G 1/12* (2006.01)
*G05G 1/10* (2006.01)
(Continued)

(52) U.S. Cl.
CPC ..... *G05G 1/12* (2013.01); *G05G 1/01* (2013.01); *G05G 1/08* (2013.01); *G05G 1/10* (2013.01);
(Continued)

(58) Field of Classification Search
CPC .. G05G 1/08; G05G 1/12; G05G 1/01; G05G 5/06; G05G 2009/04755; G05G 2009/04733; G05G 9/047
See application file for complete search history.

(56) References Cited

U.S. PATENT DOCUMENTS 9,477,329 B1 * 10/2016 Ding ..... G06F 3/0362
2010/0108476 A1 5/2010 Trudeau et al.
2017/0185099 A1 * 6/2017 Edinger ..... F24C 7/08

FOREIGN PATENT DOCUMENTS

DE 102004035960 3/2006
DE 102004035960 B4 * 2/2013 ..... B60K 37/06
(Continued)

*Primary Examiner* — Jeremy R Severson
(74) *Attorney, Agent, or Firm* — Volpe and Koenig, P.C.

(57) ABSTRACT

To improve the operator control capability of an actuating drive, switches are dispensed with and, instead, at least two rotary elements for rotational operator control are provided, arranged concentrically with respect to one another to be operatable using both hands and, in the process, are rotatable individually and independently of one another, preferably about a common axis of rotation. Rotational adjustment movements of the two rotary elements are transmitted by a magnetic coupling through a housing section, which is designed without apertures, of the actuating drive into an interior space of said actuating drive, such that, for reading out the magnetic fields, use can be made of conventional Hall sensors, and the housing of the actuating drive can be designed to be explosion-proof. In the event of failure of the rotary elements, the magnetic fields required for operator control are transmitted into the interior space using a magnetic pin for high operational reliability under all circumstances.

21 Claims, 4 Drawing Sheets

(51) Int. Cl.

| | |
|---|---|
| ***G05G 5/03*** | (2008.04) |
| ***G05G 1/01*** | (2008.04) |
| ***G05G 9/047*** | (2006.01) |
| ***G05G 1/08*** | (2006.01) |
| *G05G 5/06* | (2006.01) |
| *G05G 5/28* | (2006.01) |

(52) U.S. Cl.
CPC ..... *G05G 5/03* (2013.01); *G05G 9/047* (2013.01); *G05G 5/06* (2013.01); *G05G 5/28* (2013.01); *G05G 2009/04733* (2013.01); *G05G 2009/04755* (2013.01)

(56) References Cited

FOREIGN PATENT DOCUMENTS

| | | |
|---|---|---|
| DE | 102013008033 | 11/2014 |
| DE | 102015122457 | 6/2017 |
| EP | 1462905 | 9/2004 |

* cited by examiner

ACTUATING DRIVE WITH OPERATOR CONTROL DEVICE, AND ASSOCIATED METHOD FOR OPERATOR CONTROL

INCORPORATION BY REFERENCE

The following documents are incorporated herein by reference as if fully set forth: German Patent Application No. DE 102017110009.1, filed May 9, 2017.

BACKGROUND

The invention relates to an actuating drive having an operator control device for controlling the actuating drive, and to an associated method for the operator control of an actuating drive of this type.

Actuating drives are used in a large number of applications, in particular in installations for conveying oil and gas. Such installations are in some cases operated under extreme climatic conditions, for example in desert regions or in regions with permafrost ground. Correspondingly harsh ambient conditions can be encountered.

The safe and reliable operation of actuating drives under such conditions represents a challenge, in particular because the persons operating the actuating drives are often wearing gloves, and contamination, for example with oil, additionally occurs during the operation of the installations.

Furthermore, the functionality provided by actuating drives is ever increasing. In the case of actuating drives known from the prior art, there is therefore an observable continuous increase in the number of operator control switches. It is however sought for the actuating drives to be designed to be as compact as possible. This gives rise to conflicts because switches of a certain size required for easy operator control cannot be accommodated in arbitrary numbers in a limited space.

Furthermore, the action of dirt, corrosion or icing can cause switches to become stuck, and can thus result in a total failure of the operator control function controlled using the respective switch. This is critical in particular with regard to operational safety.

SUMMARY

It is therefore an object of the present invention to improve the operator control capability of actuating drives and increase the safety thereof. In particular, it is sought to realize a high level of complex operator control functions with the smallest possible number of operator control elements. In this way, it is sought to make a compact design of an actuating drive possible for providing a broad range of functions.

In order to achieve this object, an actuating drive having one or more features of the invention is provided. In particular, it is thus provided according to the invention, in order to achieve the object in the case of an actuating drive of the type mentioned in the introduction, that the operator control device has an inner rotary element and an outer rotary element, and the two rotary elements are arranged concentrically with respect to one another and are rotatable independently of one another about a common axis of rotation.

Through the provision of two concentrically arranged rotary elements, a new approach for the operator control of actuating drives is introduced. Here, the rotary elements permit haptics which are optimized for operator control with gloves. In particular, the operator control device can thus be designed to be free from pushbuttons, that is to say without pushbuttons.

It is also advantageous that, by contrast to the situation with rocker switches, with which only two switching states can be controlled, it is possible for varied and complex operator control functions to be realized by rotation, adjustment and rocking of the rotary elements. This is advantageous in particular if the actuating drive has a display on which the operator control functions performed by the operator control device can be displayed to the user. For example, complex graphical user interfaces depicted on the display can be navigated through easily and quickly by the two rotary switches.

The concentric arrangement of the two rotary elements ensures here that these can be designed to be as large as possible in a given space, in order to thereby permit easy and reliable operator control, in particular using gloves. The provision of a common axis of rotation is advantageous in order, for example, to permit a rotation of the individual rotary elements through 360° and at the same time as large as possible a design of said rotary elements, without the two rotary elements impeding each other in terms of their movement.

According to the invention, the object can also be achieved by further advantageous embodiments described below and in the claims.

For example, in a preferred embodiment, it is provided that the inner rotary element protrudes axially beyond the outer rotary element. It may additionally or alternatively also be provided that the outer rotary element protrudes radially beyond the inner rotary element. By these embodiments, it is ensured that operator control of the operator control device can be performed even using the bulky fingers of a glove, or for example using mittens. Here, it is considered to be particularly advantageous if the entire operator control device is accessible frontally from the front and/or if, at least partially, the circumference of one, preferably both, rotary element(s) is accessible from the side. This is because, in this way, it is made easier to grip the rotary elements.

In a further embodiment, it is advantageous if the operator control device is mounted in a non-destructively removable manner on the actuating drive. This is because, in this way, the operator control device can, in the event of damage, be replaced without the need to make major modifications to the actuating drive. This is preferably realized by a receiving device which defines the axis of rotation of the two rotary elements. A receiving device of said type may be formed for example by a recess on a housing of the actuating drive, into which recess the operator control device, in particular a peg formed on the operator control device, can be inserted. For this purpose, it is for example also possible for a thread to be provided on the peg and a corresponding counterpart thread to be provided on the receiving device. Alternatively or in addition, the receiving device may however also itself form a peg, which in turn fits into a corresponding recess of the operator control device and, with the latter, forms the axis of rotation.

In a further preferred embodiment, the outer rotary element is held axially by the inner rotary element, preferably in a limited angle range. It may alternatively be provided that the inner rotary element and the outer rotary element are each held individually, preferably by an axle that defines the axis of rotation. It is self-evident that, here, the axle may be of multi-part form. By means of these embodiments, the operator control device can for example be designed such that, during rotation of the outer rotary element, the inner rotary element is moved conjointly therewith or else such that, during rotation of the outer rotary element, the inner rotary element remains static. This is because, in both cases, it can be ensured that the inner rotary element is designed to be rotatable relative to the outer rotary element. It is thus possible for control commands to be input using the inner rotary element independently of the position of the outer rotary element.

In another embodiment, it is provided that at least one of the rotary elements has at least one recess, but preferably three recesses, for receiving a mechanical lock. Here, the recesses may be in particular in the form of a groove. Through the provision of at least one such a recess, the respective rotary element can be blocked by the lock. It is therefore possible to prevent unauthorized persons from performing operator control of the actuating drive. The formation of multiple such recesses has the advantage that the actuating drive can be secured in different states predefined by the position of the rotary element secured by the lock.

To expand operator control functions that can be performed using the operator control device, a further embodiment of the invention provides that, for one of the rotary elements, preferably for both rotary elements, there is formed at least one equilibrium position. An equilibrium position may be understood here to mean in particular a predefined position of a rotary element, proceeding from which control commands can be transmitted to the actuating drive by movement of the rotary element.

It is therefore preferable if the at least one equilibrium position can also be read out haptically by a user. The respective rotary element for which the at least one equilibrium position is formed may furthermore be deflectable out of the equilibrium position clockwise and/or counterclockwise, for example by rocking. It is thus particularly easily possible, within a menu, to navigate through individual points of the menu.

It is particularly advantageous here if the respective rotary element is deflectable out of the at least one equilibrium position counter to a first restoring force. This is because, in this way, a rocking operator control movement of the rotary element is perceptible to a user and better controllable. In other words, the haptics for complex operator control functions are improved. It may particularly preferably be provided here that the respective rotary element is switchable over from the at least one equilibrium position into an adjacent equilibrium position counter to a second restoring force. Through the provision of the second restoring force, the switching over between adjacent equilibrium positions can be distinguished from the deflection out of an equilibrium position, that is to say a rocking operator control movement, by a user. Here, it is advantageous if the second restoring force is greater than the first restoring force. This is because, in this case, the user must overcome a greater force threshold for the switching over from one equilibrium position into an adjacent equilibrium position than during the rocking movement of a rotary element. This is expedient in order to prevent inadvertent incorrect operator control.

In a further advantageous embodiment, it may be provided that an angle range of at least +/−5° is provided for deflection movements of a rotary element out of an equilibrium position, that is to say a rocking movement. This angle range however preferably amounts to at least +/−12.5°.

Such angle ranges for deflection movements may be necessary in order to permit haptics suitable for operator control using gloves. Here, the operator control device may in particular be designed such that, in an angle range provided for deflection movements, the rotary element is automatically returnable, by restoring forces, into the equilibrium position used as initial position. In this way, it is made possible that the respective rotary element, when released, always returns into a defined initial position, from which it can be deflected again. In this way, a high number of operator control movements can be performed quickly and without user fatigue, such that operator control comfort is increased.

It may alternatively or additionally also be provided that adjacent equilibrium positions of a rotary element are spaced apart from one another by at least 25°. This measure is also advantageous in order to realize haptics suitable for operator control using gloves.

In a further advantageous embodiment of the invention, it is provided that a control command input by the inner rotary element and/or by the outer rotary element can be transmitted in contactless fashion, in particular by a magnetic coupling, into a preferably sealed interior space of the actuating drive. This is because the invention has recognized that, by the use of magnets recessed into the rotary elements, in particular at the rear side, it is possible in a particularly elegant manner for complex control commands to be transmitted through a hermetic housing of an actuating drive, such as is prescribed in particular in explosive environments, that is to say for example in gas conveying installations.

For this purpose, the invention proposes in particular the provision of a circuit board on an inner side of a housing cover of the actuating drive, to which circuit board magnetic field sensors, preferably Hall sensors, are attached in a manner corresponding to the magnets of the rotary element, as will be discussed in more detail below. A magnetic coupling between the operator control device and the actuating drive is thus produced by the magnets on the outside in relation to the housing of the actuating drive and the magnetic field sensors on the inside in relation to the housing of the actuating drive.

The contactless transmission of control commands input by the rotary elements is advantageous because, here, by contrast to the situation with conventional switches, apertures in the housing of the actuating drive can be omitted. In other words, the operator control device can thus be mounted on a housing cover which, aside from bores for fastening screws, is designed to be free from apertures.

To achieve the object mentioned in the introduction in the case of an actuating drive with an operator control device for controlling the actuating drive, it is alternatively or additionally provided that the operator control device has a rotary element which has at least one magnet for transmitting operator control movements or control commands into an interior space of the actuating drive. Here, magnetic field sensors for reading out the operator control movements of the rotary element may be arranged in particular in the interior space of the actuating drive.

According to the invention, with regard to the specific arrangement of the magnet or of the magnets within the respective rotary element, it is advantageous if the at least one magnet, in particular the magnets, is/are arranged radially at the outside, and/or so as to face a housing of the actuating drive, in or on the rotary element. The arrangement radially at the outside has the advantage here that the distance covered by a magnet during a rotational movement of the rotary element is maximized. This enables said movement to be read out with high precision. The arrangement axially at the inside, that is to say in particular at or on a rear side, facing toward the housing of the actuating drive, of the respective rotary element has the advantage that a spacing between the respective magnet and a magnetic field sensor corresponding thereto in the interior space of the actuating drive is minimized, whereby a high magnetic field strength at the magnetic field sensor is realized. This is also advantageous for being able to reliably read out the movements of the respective rotary element, in particular allowing for temperature fluctuations, which can influence the sensitivity of the magnetic field sensors.

In a further embodiment, implementing the magnetic transmission concept, complex operator control functions can be realized particularly easily if each equilibrium position of a rotary element is assigned a pair composed of a magnet held by the rotary element and of a magnetic field sensor of a first type arranged in the desired equilibrium position within a housing of the actuating drive. Here, it may be provided in particular that a magnet held by the rotary element is assigned to all equilibrium positions of the rotary element. In other words, this magnet thus generates, in all equilibrium positions used for the control of the actuating drive, a magnetic field strength which can be detected by a magnetic field sensor arranged in the equilibrium position, such that the equilibrium positions can be reliably detected.

It is particularly preferable here if at least one further magnetic field sensor of a second type and/or at least one further magnet are/is provided. This is because, by use of these alternative or additional embodiments, a deflection of the respective rotary element out of an equilibrium position, and preferably the direction of rotation used in the process, is detectable. This is possible because, in addition to a first field strength that is detected by the magnetic field sensor of the first type, a second field strength, which in particular differs from said first field strength, can be detected by the magnetic field sensor of the second type. Through continuous measurement of these two field strengths by the magnetic field sensors of the first and second types, it is made possible to draw conclusions regarding the deflection of the rotary element and in particular regarding the direction of rotation used in the process.

In one refinement of the invention, it is particularly advantageous if the magnetic field sensors of the first type are, for the detection of the set equilibrium positions, arranged so as to be spaced apart from one another such that their magnetic field detection regions do not overlap. Here, a magnetic field detection region may be understood to mean a region, in particular angle range, within which the respective magnetic field sensor is still capable of detecting the presence of a magnet attached to one of the rotary elements. Through the avoidance of overlaps, it can thus be ensured that, in an equilibrium position, always only one of the magnetic field sensors of the first type responds, such that undefined states are avoided.

Alternatively or in addition, it may also be provided here that each equilibrium position of a rotary element, that is to say in particular of the inner and/or of the outer rotary element, is assigned two magnetic field sensors of the second type. Each of these two magnetic field sensors of the second type is designed here for detecting a deflection out of the respective equilibrium position in in each case one direction. By this embodiment, it is for example possible, proceeding from an equilibrium position, for two different direction commands to be transmitted to the actuating drive by rocking the respective rotary element clockwise or counterclockwise. In this way, it is for example possible to navigate up or down within a menu, or it is for example possible for an actuating drive to be moved in a forward or reverse direction.

In a further embodiment, the operator control device may be designed such that at least two magnets are formed on a rotary element. Here, one of the at least two magnets interacts with the magnetic field sensors of the first type in order to detect the equilibrium positions, whereas a further magnet of the at least two magnets interacts with the magnetic field sensors of the second type in order to detect deflections of the rotary element out of an equilibrium position. In this embodiment, too, it is advantageous if the magnetic field sensors of the first type are spaced apart from the magnetic field sensors of the second type such that their magnetic field detection regions do not overlap.

To permit the most efficient possible utilization of the magnetic field sensors, the invention provides inter alia that, for N equilibrium positions of a rotary element, there are provided in each case N magnetic field sensors of the first type for the detection of the equilibrium positions. Alternatively or in addition, it is also provided that, in the case of N equilibrium positions, N+1 further magnetic field sensors of the second type are provided for the detection of operator control movements of the rotary element (3, 4). Said N+1 magnetic field sensors of the second type may in this case be provided in particular for the detection of a direction of rotation of the rotary element.

To achieve the object mentioned in the introduction in the case of an actuating drive with an operator control device for controlling the actuating drive, it is alternatively or additionally suggested that a spring element is provided for generating a restoring force during the deflection and/or switchover of a rotary element. By use of the spring element, it is thus possible for restoring forces to be exerted on the rotary element during deflection of said rotary element, which restoring forces provide feedback, which can be read out haptically by a user, regarding the adjustment of the rotary element. In this way, the operator control of the operator control device is made much more convenient and less strenuous for a user.

Here, the spring element preferably interacts with the rotary element such that a rate of a rise of the restoring force increases with the deflection of the rotary element out of an equilibrium position. Here, it may be provided in particular that said rate of the rise of the restoring force increases before the engagement of the rotary element into a new, adjacent equilibrium position. In a particularly preferred embodiment, for this purpose, different gradients may be provided on a bracing ramp, with which different gradients the spring element interacts in order to increase the rate of the rise of the restoring force.

A refinement of this mechanism with spring element provides that a detent mechanism is provided which provides an engagement, which can be read out haptically, of the respective rotary element in at least one equilibrium position. For this purpose, for example, the spring element itself may be designed for the engagement in the equilibrium position. An engagement into more than one equilibrium position, for example in two, three, four or more than four equilibrium positions, is preferably configured so as to be capable of being read out haptically.

In one embodiment of the invention, the spring element is a leaf spring. In the case of a leaf spring being used, it is advantageous if this is held, in the region of its two ends, by a rotary element. This holding configuration may be configured in particular such that the leaf spring is pivotable about support bearings spaced apart from the ends thereof.

Furthermore, it may alternatively or additionally be provided that the ends of the leaf spring are movable, and/or that the leaf spring is of M-shaped configuration.

In one specific embodiment, a cam disk with a sequence of different inclines may be provided. This cam disk can interact with the spring element, preferably with the leaf spring, in order to generate restoring forces of different intensity. In a preferred embodiment, for this purpose, the leaf spring forms a projection, preferably in the form of a convex detent lug, for engagement into at least one corresponding recess of the cam disk, wherein it is self-evidently also possible for multiple such recesses to be provided, depending on the number of equilibrium positions. In a particularly preferred variant, the cam disk furthermore forms end stops. This is because, with these end stops, operator control movements of the rotary element can be rotationally limited. In this way, it is for example possible to prevent the rotary element from being rotated too far.

In a further embodiment, it may be provided that the operator control device is fastenable or fastened by the above-described cam disk to the housing of the actuating drive. For this purpose, the cam disk may be connected or connectable to the housing in particular in punctiform fashion, preferably by a single screw connection. Alternatively or in addition, the cam disk may be connected or connectable to the housing by an axle, in particular the axle described above. Furthermore, the cam disk may bear areally against the housing.

In a preferred embodiment, the cam disk has an encircling rim. The rim is advantageous for increasing the mechanical stability of the cam disk and for providing wide surfaces for the above-described end stops and for the engagement of the spring element.

To realize a particularly efficient and reliable magnetic coupling, the invention proposes that the inner rotary element, in particular a section, which bears a magnet, of the rotary element, is guided through the outer rotary element and/or through the cam disk to the housing of the actuating drive.

Here, it is preferable if a passage window is formed on the cam disk and/or on the outer rotary element. This is because, in this case, it is for example possible for the above-described rim to be of encircling design, which serves for the stability of the cam disk.

To achieve the object in the case of an actuating drive as described in the introduction, the invention alternatively or additionally provides that operator control of the actuating drive can be performed by a magnetic pin. For this purpose, the pin has a magnet at its tip, which magnet, if it is moved close to the outer side of the housing of the actuating drive, can trigger a magnetic field sensor in the interior of the actuating drive and thus impart a control command. It is advantageous here for such pin-based operator control to be configured in particular so as to be possible without actuation of a rotary element or of some other operator control element. In this way, an alternative is thus created with which operator control of the actuating drive can still be reliably performed even in the event of a failure of a rotary or operator control element, for example owing to icing, in an emergency situation.

It is self-evidently possible, for the purposes of the pin-based operator control, for magnetic field sensors to be provided in particular in a (protected) interior space of the actuating drive. According to the invention, it is furthermore advantageous if a facility for changing the operator control device over from manual operator control (that is to say by rotary or other operator control elements) to pin-based operator control is provided. This changeover between the operating modes may in this case be performed using the magnetic pin.

To simplify the operator control by the magnetic pin, it may furthermore be provided that an arrangement of magnetic field sensors of the actuating drive is marked on an outer side of the housing of the actuating drive. Such a marking may for example also be applied below the, preferably removable, operator control device, such that no additional surface area is required. The markings or operator control symbols may be easily formed for example by adhesive labels or inscribed metallic plates.

According to the invention, to achieve the stated object, one or more features of the method may be used. In particular, according to the invention, to achieve the object in the case of a method for the operator control of an actuating drive, wherein the actuating drive has an operator control device with at least one rotary element and may be designed in particular as described above, it is provided that all of the control commands required for the operation of the actuating drive can be input by operator control of the at least one rotary element, that is to say in particular by operator control of two rotary elements. This method thus provides, in a complete departure from previous approaches, that the number of operator control elements be kept as low as possible and that the required complexity of operator control be ensured not by a high number of operator control elements but by complex operator control capability of the rotary elements. Here, in the case of at least two rotary elements being used, it is preferable if operator control of these is performed partially simultaneously and/or in parallel and/or using two hands. This is because, in this way, it is possible for even complex control commands to be transmitted easily, reliably and quickly to the actuating drive.

To achieve the stated object, the invention alternatively or additionally provides a further method. This provides that, for the operator control of an actuating drive using an operator control device with at least one rotary element, all of the control commands required for the operation of the actuating drive are transmitted in contactless fashion through a housing of the actuating drive into an interior space of the actuating drive. This method is expedient in particular for applications in which high demands are placed on explosion protection, such that leadthroughs through the housing of the actuating drive should be avoided as far as possible.

According to the invention, the methods presented above can be advantageously further refined if control commands are transmitted to the actuating drive preferably exclusively by virtue of at least one rotary element being rotated from a first equilibrium position into an adjacent equilibrium position. Alternatively or in addition, it is also possible for a rotary element to be deflected out of an equilibrium position as far as defined switchover points in order to transmit control commands. For easy operator control, it is particularly advantageous here if both the equilibrium positions and the switchover points can be read out haptically. For this purpose, the invention proposes in particular that the at least one rotary element is held in the equilibrium positions by a detent mechanism.

A further refinement of the method provides for providing a possibility, preferably using the abovementioned magnetic pin, of switching over between manual operator control by the at least one rotary element and operator control by the magnetic pin. Here, the switchover between the operator control modes may advantageously be performed by using of the magnetic pin.

BRIEF DESCRIPTION OF THE DRAWINGS

The invention will now be described in more detail on the basis of exemplary embodiments, but is not restricted to these exemplary embodiments.

Further exemplary embodiments arise through combination of the features of individual or multiple claims with one another and/or with individual or multiple features of the respective exemplary embodiment. In particular, it is thus possible for embodiments of the invention to be obtained from the following description of a preferred exemplary embodiment in conjunction with the general description, the claims and the drawings.

In the drawings:

Figure 1:
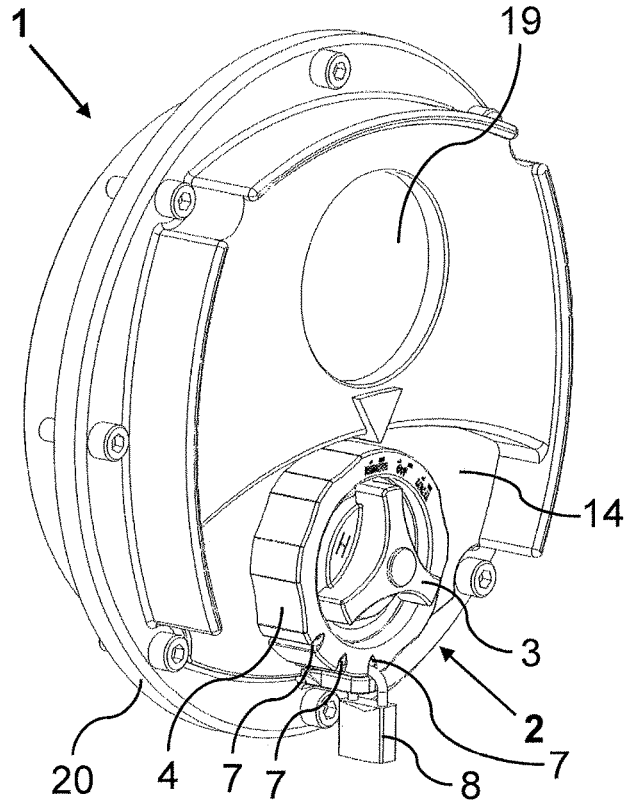
Figure 2:
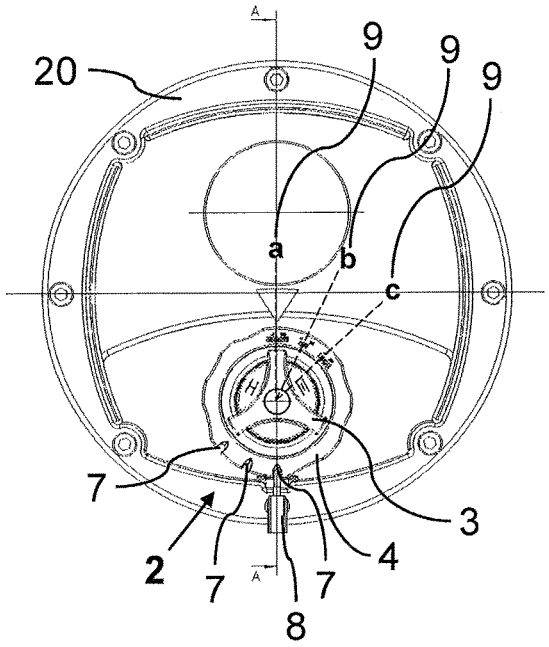
Figure 3:
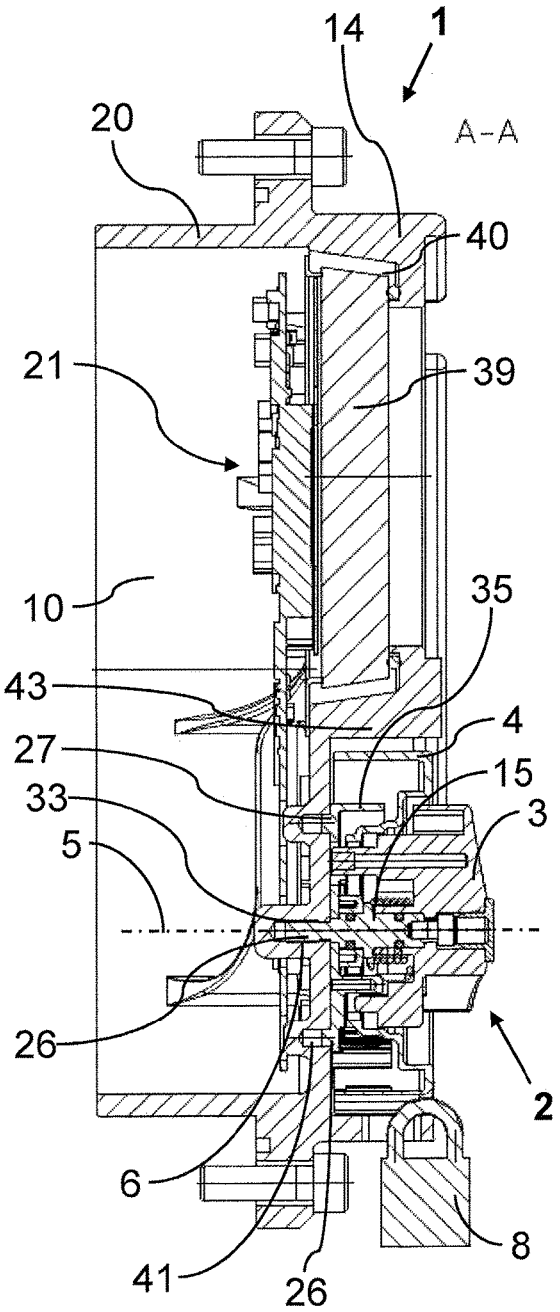
Figure 4:
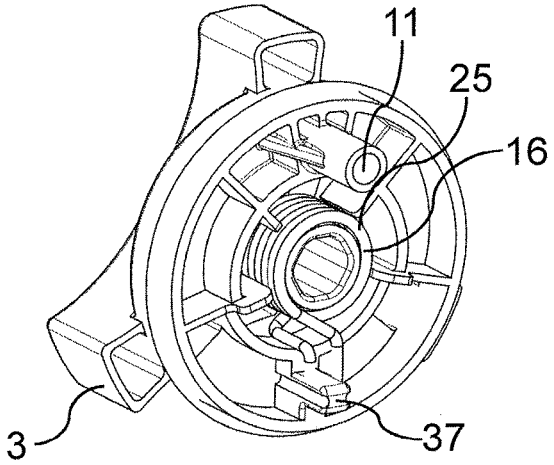
Figure 5:
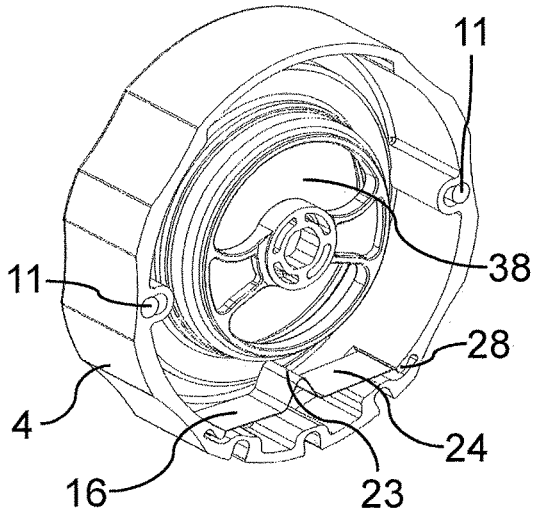
Figure 6:
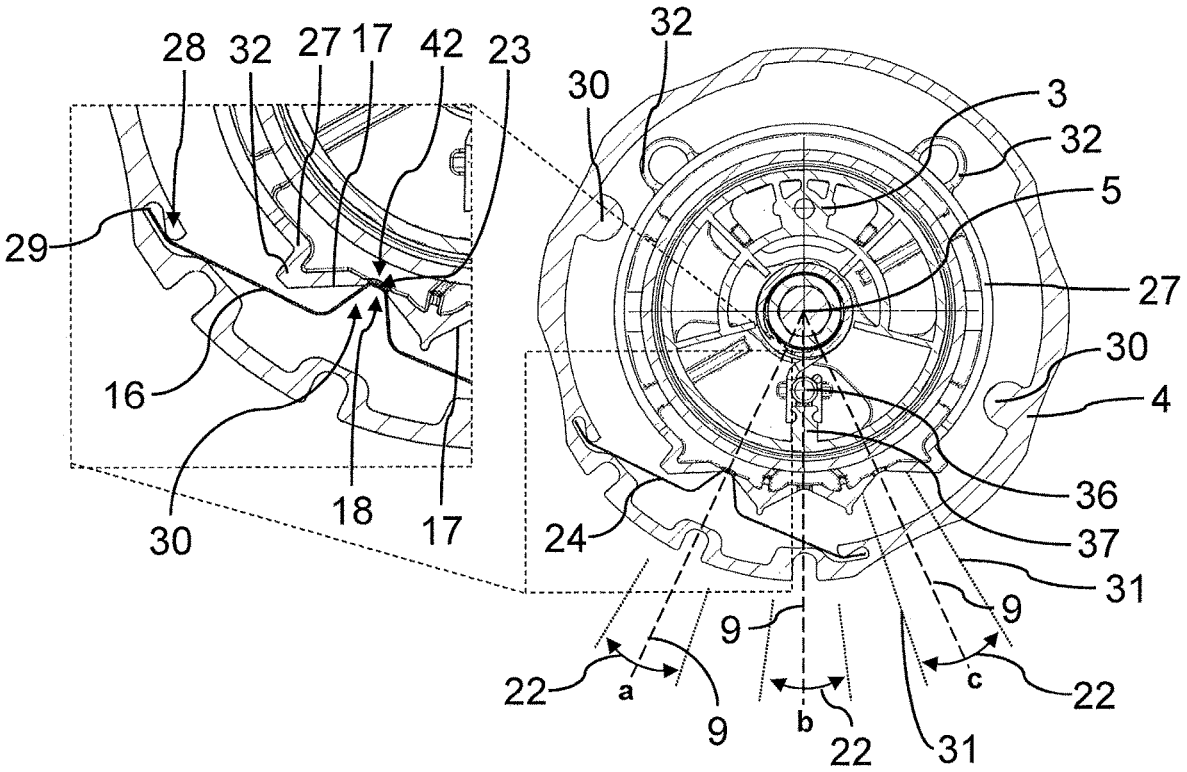
Figure 7:
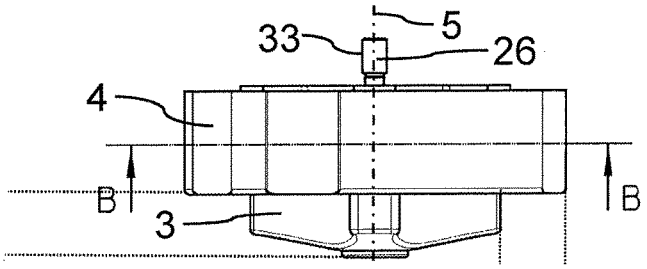
Figure 8:
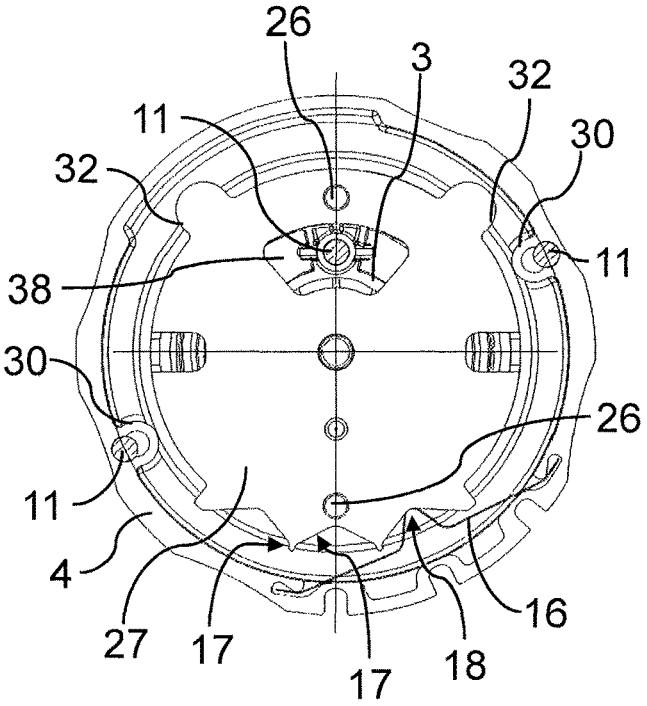
Figure 9:
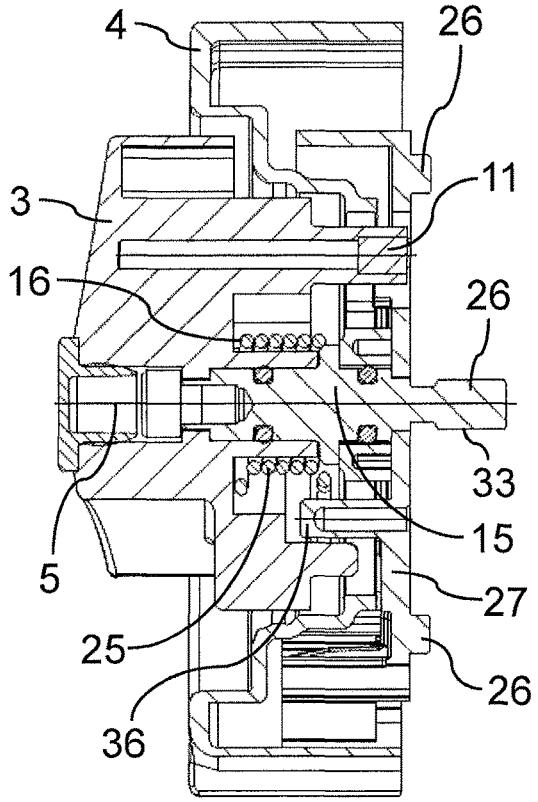
Figure 10:
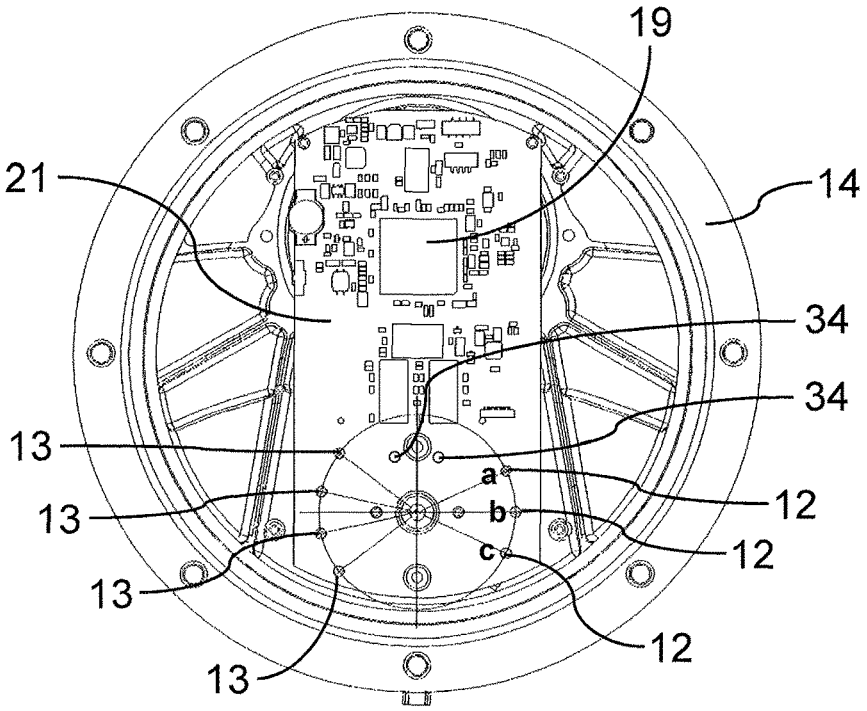
Figure 11:
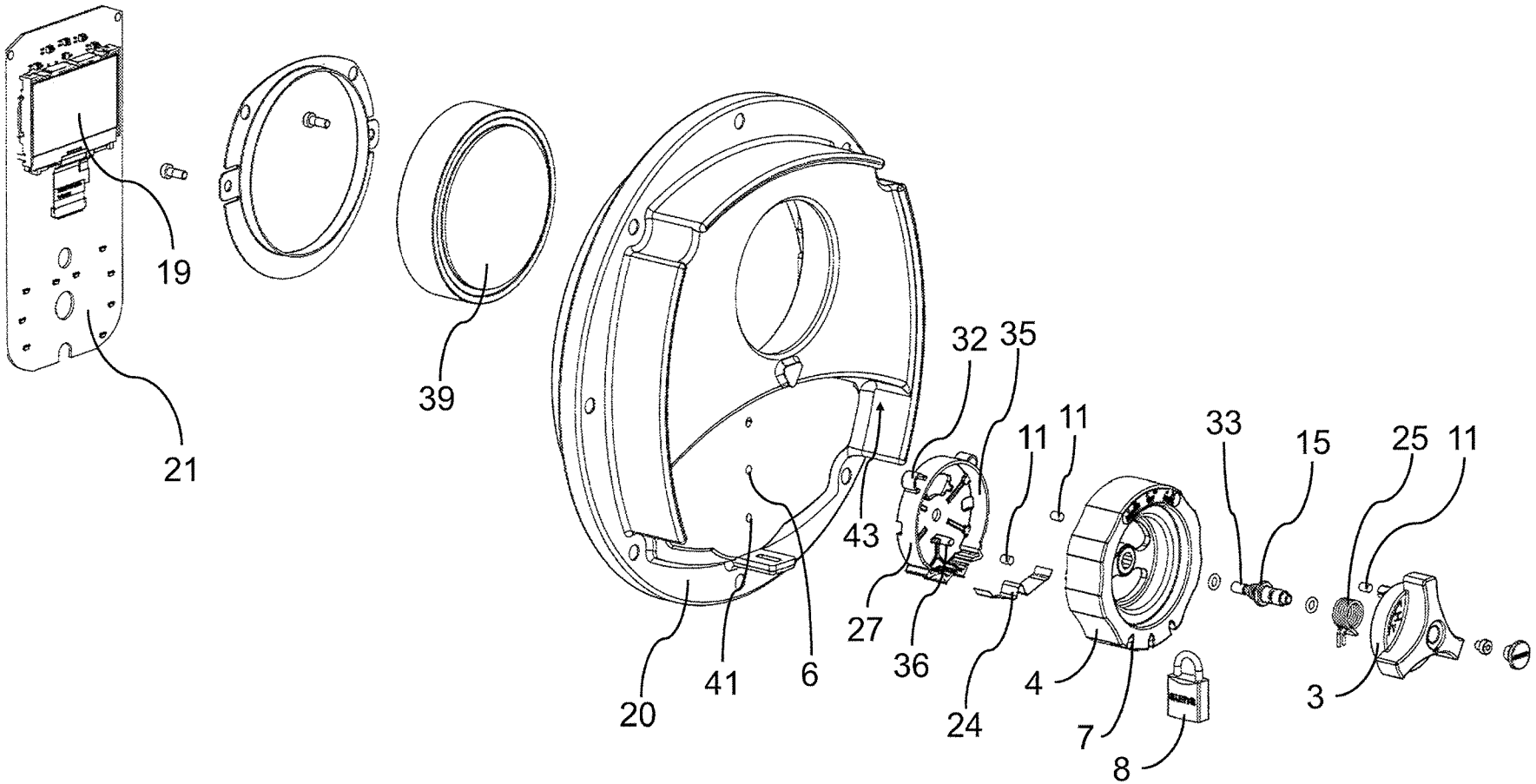

FIG. 1 shows a perspective view of a frontal housing cover of an actuating drive according to the invention with, attached thereto, an operator control device according to the invention with two rotary elements, FIG. 2 shows a frontal view from the front of the housing cover of the actuating drive from FIG. 1, FIG. 3 shows a side-on cross-sectional view of the housing cover of the actuating drive from FIG. 1, FIG. 4 shows a perspective view from the rear of an inner rotary element of an operator control device according to the invention, FIG. 5 shows a perspective view from the rear of an outer rotary element of an operator control device according to the invention, FIG. 6 shows a frontal view from the rear of the two rotary elements, inserted one inside the other, of FIGS. 4 and 5, and a detailed view that discloses a detent mechanism, FIG. 7 shows a view from above of the two rotary elements, inserted one inside the other, of FIGS. 4 and 5, FIG. 8 shows a rear view of the operator control device, showing the two rotary elements and a cam disk, FIG. 9 shows a side-on cross-sectional view of the operator control device, which discloses the holding configuration of the two rotary elements, FIG. 10 shows a frontal view of the actuating drive after removal of the housing cover, such that a circuit board with magnetic field sensors, which is situated behind the housing cover and arranged in the interior space of the actuating drive, can be seen, and FIG. 11 shows an exploded view of an actuating drive according to the invention with the operator control device described above.

DETAILED DESCRIPTION

FIG. 1 shows a housing cover 20 as part of a housing 14 of an actuating drive 1 which, as illustrated in FIG. 3, delimits a protected interior space 10 of the actuating drive 1 with respect to the outside. For the control of the actuating drive 1, an operator control device 2 is attached to the outside of the housing cover 20, which operator control device, as shown in FIG. 1, has an inner rotary element 3 and an outer rotary element 4.

As can be seen in the cross-sectional view of the housing cover 20 in FIG. 3, the two rotary elements 3, 4 are arranged concentrically with respect to one another, such that they are rotatable independently of one another about a common axis of rotation 5.

For this purpose, the two rotary elements 3, 4 are mounted rotatably on a common static axle 15 (see also FIG. 9). The axle 15 forms a stud 26 with a thread 33 which is screwed into a receiving device 6 on the housing 14, more specifically on the housing cover 20, of the actuating drive 1. The receiving device 6 is designed as a blind hole with an internal thread that fits with the stud 26 of the axle 15. The axle 15 and the receiving device 6 thus together define the axis of rotation 5 of the operator control device 2.

Due to the screw connection produced between the receiving device 6 and the stud 26 of the axle 15, the operator control device 2 can be non-destructively removed from the actuating drive 1 by virtue of the axle 15 being unscrewed from the receiving device 6. After the removal of the operator control device 2, the outer surface, situated beneath said operator control device, of the housing cover 20 is accessible, which permits the above-discussed operator control of the actuating drive 1 by the use of a magnetic pin.

As can also be seen in FIG. 3, further studs 26 are formed on the operator control device 2, more specifically on a cam disk 27, which studs engage into corresponding recesses 7 of the housing cover 20. The cam disk 27 thus serves as a holding plate for further fixtures.

The studs 26 of the cam disk 27 secure the operator control device 2 against rotation. Therefore, a single screw connection is sufficient for connecting the operator control device 2 to the actuating drive 1 in rotationally fixed fashion.

A notable feature of the technical solution illustrated in FIG. 3 is that the housing cover 20 can be designed to be free from apertures, in particular in the region of the operator control device 2, because control commands can be transmitted into the interior space 10 by the above-described magnetic coupling. The operator control device 2 therefore also has no electronics whatsoever, and is therefore highly failsafe.

As can be clearly seen in FIG. 1, three groove-like recesses 7 are formed on the outer rotary element 4. Into said recesses 7 there can be inserted, in each case, a mechanical lock 8 in order to fix the position of the outer rotary element 4 and secure the latter against unauthorized access. For this purpose, the mechanical lock 8 engages into a corresponding recess 7 of the housing 14, as can be seen in FIG. 2 and FIG. 3.

The outer rotary element 4 can be positioned in three different equilibrium positions 9, which are denoted in FIG. 2 by the lowercase alphabetic characters a, b and c, in order to set different operating modes of the actuating drive 1. The equilibrium positions 9*a*, 9*b* and 9*c* illustrated in the frontal view of FIG. 2 correspond here to the equilibrium positions 9, likewise designated with the lowercase alphabetic characters a, b and c, in the rear view of the operator control device 2 in FIG. 6, wherein, owing to the rear view, the directional orientation in FIG. 6 is reversed in relation to FIG. 2.

As shown in FIGS. 4 and 5, each of the two rotary elements 3, 4 has in each case one spring element 16. In the case of the outer rotary element 4, the spring element 16 is in the form of a leaf spring 24.

By contrast, the spring element 16 of the inner rotary element 3 is formed as a helical spring 25. In the exemplary embodiment shown in FIG. 4, the ends of the spring element 16 of the inner rotary element 3 are in this case equipped with legs, such that said spring element forms a leg spring. For the bracing of said leg spring, a driver 37 is formed on the inner rotary element. As shown in FIGS. 6 and 11, it is furthermore the case that a holding element 36 is formed on a cam disk 27, which holding element holds one of the two legs of the leg spring fixed in a manner dependent on the deflection of the inner rotary element 3.

By use of the spring elements 16 (that is to say the leaf spring 24 and the helical spring 25), restoring forces can be generated which can be read out haptically by a user, such that the user can feel the adjustment of the respective rotary element 3, 4.

As can be seen viewing FIGS. 5 and 6 together, on the leaf spring 24 of the outer rotary element 4, there is formed a projection 30 by which the leaf spring 24 can engage into corresponding recesses 7 that are formed on a cam disk 27 of the operator control device 2. From the detailed view of FIG. 6, it can be seen that the recess 7 of the cam disk 27 is designed so as to fit with the convex tip of the projection 30 of the leaf spring 24, which forms a detent lug 23 (see FIG. 5). Therefore, the leaf spring 24 can engage securely in the recess 7. In other words, a detent mechanism 18 is formed by the interaction of the leaf spring 24 with the cam disk 27.

During rotation of the outer rotary element 4 relative to the static cam disk 27, which bears areally against the housing 14, the projection 30 of the leaf spring 24, which is moved conjointly with the outer rotary element 4, moves along a bracing ramp 17 of the cam disk 27. Here, different gradients are formed on the bracing ramp 17, such that, with increasing deflection out of an equilibrium position 9, the restoring force generated by the leaf spring 24 and acting on the outer rotary element 4 increases continuously.

Considering the detailed view of FIG. 6 more closely, it can also be seen that the gradient of the bracing ramp 17 increases abruptly at a point at which a pointed lug is formed on the cam disk 27. The rate of the rise of the restoring force thus not only increases with the deflection of the outer rotary element 4 but also noticeably increases once again, specifically when the leaf spring 24 reaches the lug of the cam disk 27. In this way, a switchover point 31 that can be read out haptically can be defined, which switchover point must be overcome for example if the user wishes to switch over from the equilibrium position 9*a* illustrated in FIG. 6 into the equilibrium position 9*b*.

Furthermore, two end stops 32 in the form of protuberances are formed on the cam disk 27. The projections 30 formed on the outer rotary element 4 abut against said end stops 32, such that the rotation of the outer rotary element 4 is limited to a predefinable angle range, as can be easily comprehended when viewing FIG. 6.

As shown in the cross-sectional view of FIG. 9, the inner rotary element 3 and the outer rotary element 4 are each held individually by the static axle 15, which also predefines the common axis of rotation 5. Thus, the two rotary elements 3, 4 can be rotated independently of one another and in particular counter to one another, which permits complex operator control functions.

If, for example, the outer rotary element 4 is rotated while the inner rotary element 3 is stationary, then, owing to the leaf spring 24 discussed above, a first restoring force acts as soon as the outer rotary element 4 is deflected out of one of the three equilibrium positions 9*a, b* and *c*.

By contrast, if it is sought to adjust the outer rotary element 4 for example from the equilibrium position 9*a* illustrated in FIG. 6 into the equilibrium position 9*b*, the user must overcome a second restoring force which is greater than the restoring force mentioned above.

This second restoring force acts at the above-described switchover points 31. In the exemplary embodiment illustrated in FIG. 6, the second restoring force acts specifically when the leaf spring 24 must overcome the lug formed on the cam disk 27 between the equilibrium positions 9*a* and 9*b*. Here, the abrupt steepening of the gradient of the bracing ramp ensures that this switchover is noticeable to the user.

In particular, two-handed and simultaneous operator control of the inner rotary element 3 and of the outer rotary element 4 is, as illustrated in FIG. 7, made much easier in that, firstly, the outer rotary element 4 protrudes radially beyond the inner rotary element 3 (see the two dotted vertical lines) and in that, furthermore, the inner rotary element 3 protrudes axially beyond the outer rotary element 4 (as indicated by the two dotted horizontal lines in FIG. 7). This is because, in this way, in the case of operator control using gloves, the respective rotary element can be easily gripped.

The exemplary embodiment of an operator control device 2 shown in FIG. 6 has a yet further functionality, as indicated by the angle ranges denoted by the reference designation 22: the outer rotary element 4 can, in each case proceeding from one of the equilibrium positions 9*a*, 9*b* or 9*c*, be deflected counter to the above-described first restoring force, specifically in both directions of rotation. By this "rocking" of the outer rotary element 4, it is for example possible in an elegant manner to navigate up and down within a menu. Here, due to the acting restoring forces, the outer rotary element 4 returns in each case automatically into the equilibrium position 9 used as initial position.

In order that an adequately large deflection range is available for such rocking movements, it is the case in the exemplary embodiment shown in FIG. 6 that the adjacent equilibrium positions 9, that is to say for example the positions 9*a* and 9*b*, are spaced apart from one another by 25°. For the rocking movements themselves, an angle range of approximately +/−10° is available, which can be read out by the magnetic field sensors of a second type 13 (cf. FIG. 10).

A further aspect of the invention illustrated in the figures consists in the contactless transmission of control commands, input by the rotary elements 3 and 4, to the actuating drive 1, more specifically into the protected interior space 10 of the actuating drive 1. This is because, as can be clearly seen in FIG. 3, the housing cover 20 is formed without apertures in the region of the operator control device 2. In each case on the rear side facing toward the housing 14, two magnets 11 are recessed into the outer rotary element 4 and a further magnet 11 is recessed into the inner rotary element 3, as shown in FIGS. 4 and 5. In a manner corresponding to these magnets 11, at the inner side, that is to say in the protected interior space 10 and thus behind the housing cover 20, multiple magnetic field sensors 12, 13, 34 are arranged on a circuit board 21, which magnetic field sensors are illustrated as hatched circular areas in FIG. 10.

Here, for the detection of the three equilibrium positions 9*a*, 9*b* and 9*c* (see FIG. 2) of the outer rotary element 4, N=3 magnetic field sensors of a first type 12 are provided (see FIG. 10). By contrast, N=3+1=4 magnetic field sensors of the second type 13 are arranged on the circuit board 21. These four further magnetic field sensors 13 are exactly sufficient for detecting in each case, in each of the three equilibrium positions 9*a*, 9*b* and 9*c*, rocking movements, that is to say rotational operator control movements, of the outer rotary element 4, and in particular the direction of rotation used in the process (clockwise or counterclockwise).

As shown in FIG. 10, all seven magnetic field sensors of the first and second types 12, 13 used for the detection of equilibrium positions 9 or of operator control movements of the rotary element 4 are situated on a common circular line. This circular line corresponds specifically to the path covered by the two magnets 11 of the outer rotary element 4 (illustrated in FIG. 8) during a rotation of the rotary element 4. As can be clearly seen on the basis of FIG. 8, the two magnets 11 of the outer rotary element 4 are arranged radially at the outside on the outer rotary element 4, resulting in a correspondingly large diameter of the above-described circle in FIG. 10. Such an arrangement is advantageous in order to increase the angular resolution for the reading-out of the operator control movements of the rotary element 4.

For the reading-out of rotary operator control movements of the inner rotary element, more specifically of the magnet 11 thereof, two further magnetic field sensors of a third type 34 are arranged on the circuit board 21 in FIG. 10.

In FIG. 9, it can be clearly seen that the single magnet 11 of the inner rotary element 3 is, analogously to the two magnets 11 of the outer rotary element 4, arranged axially at the inside, that is to say on the rear side of the rotary element 3, so as to face toward the housing 14 of the actuating drive 1. From the cross section of FIG. 3, it can be seen that such an arrangement is advantageous for minimizing the distance between the magnetic field sensors 12, 13, 34 at the inner side and the respective magnet 11.

Furthermore, in FIGS. 5, 8 and 9, it can be seen that a section of the inner rotary element 3, which bears the single magnet 11 thereof, is guided firstly through a passage window 38 formed in the cam disk 27 and secondly through a further passage window 38 of the outer rotary element 4 (cf. FIG. 5). It is thereby achieved, as illustrated on the basis of FIG. 3, that the magnet 11 is positioned as close as possible to the outer wall of the housing 14 of the actuating drive and thus as close as possible to the magnetic field sensors 34 in the interior space 10. This is advantageous in order that as strong as possible a magnetic field acts on the magnetic field sensor.

In the exemplary embodiment illustrated in the figures, the magnet 11, illustrated at the bottom left in the rear view of FIG. 8, of the outer rotary element 4 is assigned to all equilibrium positions 9*a*, 9*b* and 9*c* (see FIG. 2). If, for example in FIG. 2, the outer rotary element 4 is rotated counterclockwise from the equilibrium position 9*c* into the equilibrium position 9*b* and subsequently into the equilibrium position 9*a*, the above-describe magnet 11, described immediately above, of the outer rotary element 4 passes through the positions designated by the alphabetic characters c, b, a in FIG. 10. In other words, it is thus the case in each equilibrium position 9 that one of the magnetic field sensors of the first type 12 illustrated in FIG. 10 forms a pair together with the above-described magnet 11 (at the bottom left on the outer rotary element 4 in FIG. 8), which pair is assigned to the respective equilibrium position 9*a*, 9*b* or 9*c*.

If the outer rotary element 4 is situated for example in the equilibrium position 9*c* shown in FIG. 2, then the two upper magnetic field sensors of the second type, denoted by the reference designations 13 in FIG. 10, on the circuit board 21 serve for detecting deflections of the outer rotary element 4 clockwise or counterclockwise out of the equilibrium position 9*c*. By processing the signals of the magnetic field sensors of the first type 12 and second type 13, it is also possible here to draw conclusions regarding the present direction of rotation of the rotary element 4.

Here, in FIG. 10, adjacent magnetic field sensors of the first and second types 12, 13 are spaced apart from one another on the circuit board 21 to such an extent that their magnetic field detection regions do not quite overlap. It is ensured in this way that, in every position of the outer rotary element 4, in each case only one of the magnetic field sensors of the first type 12 or only one of the magnetic field sensors of the second type 13 is excited by the magnet 11 of the outer rotary element 4 and thus generates a corresponding signal.

Viewing FIGS. 2, 8 and 10 together, it is very clear that the uppermost magnetic field sensor of the second type 13 in FIG. 10 is designed for detecting a deflection of the outer rotary element 4 clockwise out of the equilibrium position 9*c*, and the magnetic field sensor of the second type 13 arranged therebelow, that is to say the second-uppermost magnetic field sensor of the second type 13, is correspondingly designed for detecting a deflection of the outer rotary element 4 counterclockwise out of the equilibrium position 9*c* (see also FIG. 2).

A further aspect of the present invention consists in the formation of a complex detent mechanism 18, the functioning of which has already been discussed in detail on the basis of FIG. 6. As illustrated in the detail of FIG. 6, the M-shaped leaf spring 24 is fixedly connected to the outer rotary element 4. Said spring element 16 is in this case inserted into the outer rotary element 4 such that the two ends 29 of the leaf spring 24 are freely movable. This is achieved in that the leaf spring 24 is braced between two support bearings 28 which are formed on the outer rotary element 4, in each case spaced apart from the ends 29 of the leaf spring 24. Since the leaf spring 24 is pivotable about said support bearings 28, rigid bracing and thus premature fatigue of the leaf spring 24 can be avoided.

By use of the above-described projection 30 which is formed on the leaf spring 24, which engages into the corresponding recesses 7 on the cam disk 27 and which in particular interacts with the different gradients of the bracing ramps 17 of the cam disk 27, it is possible for both holding forces and restoring forces to be exerted on the rotary element 4, which forces can be read out haptically by a user. It is advantageous here that, during the operator control of the operator control device 2, a user can direct his or her view to the display 19 shown in FIG. 1. The user can thus, even without having to direct his or her view to the operator control device 2, perform operator control of the operator control device 2 quickly, precisely and in a fatigue-free manner solely on the basis of the haptic feedback during the deflection of the rotary elements 3 and 4 or during the switchover between the individual equilibrium positions 9. Thus, the operator control of the actuating drive 1 is made much easier and faster in relation to conventional switch elements.

In the case of the M-shaped leaf spring 24 shown in FIG. 6, the restoring force is greater the further radially to the outside the convex tip of the centrally formed projection 30 of the leaf spring 24 is situated. Therefore, in the exemplary embodiment shown in FIG. 6, the restoring force exerted by the leaf spring 24 is at a maximum specifically when the leaf spring 24 passes over the lugs arranged radially at the outside between adjacent bracing ramps 17 of the cam disk 27.

To increase reliability in the operator control of the actuating drive 1, the invention furthermore proposes a method with which operator control of the actuating drive 1 can be performed by a magnetic pin. This is because, viewing FIGS. 3 and 10 together, it can be seen that, after the removal of the operator control device 2 from the housing cover 20 of the actuating drive 1 (see FIG. 3), the magnetic field sensors 12, 13, 34 arranged on the inner side on the circuit board 21 are separated from the outside environment only by the housing cover 20. It is thus sufficient for a pin with a magnetic tip to be brought into the vicinity of the positions, marked by hatched circular areas in FIG. 10, of the magnetic field sensors 12, 13, 34 in order to trigger corresponding control commands.

Here, to simplify the operator control, it may be provided that, after removing the operator control device 2 from the actuating drive 1, a user, using the magnetic pin and with guidance being given for example by a user interface presented on the display 19, firstly changes the actuating drive 1 over from manual operator control to pin-based operator control. For this purpose, it may for example be provided that certain magnetic field sensors 12, 13, 34 must be triggered successively in a particular sequence using the magnetic pin.

As shown in FIG. 1, the operator control device 2 is accessible both from the side, specifically from below, and frontally, such that in particular, operator control using two hands simultaneously is possible. Here, it is for example possible for operator control of the outer rotary element 4 to be performed using the left hand and of the inner rotary element 3 to be performed using the right hand.

To be able to utilize rocking movements of the outer rotary element 4 for inputting control commands, the defined switchover points 31 shown in FIG. 6 are provided. It may for example be provided that a corresponding control command is first triggered when the rotary element 4, or the magnet 11 used for the same, reaches the above-described switchover point 31 or the switchover points 31 illustrated in FIG. 6.

As a result of the engagement of the projection 30 of the leaf spring 24 in the corresponding receptacle 7 of the cam disks 27, it is ensured that the outer rotary element 4 is held securely in the respective equilibrium position 9. There is thus always a defined initial position available, proceeding from which rotational operator control movements can be performed.

Finally, FIG. 11 shows an exploded view of the operator control device 2 and of the housing cover 20 and of the circuit board 21 protected by said housing cover. In particular, the thread 33 formed on the axle 15, the encircling rim 35 of the cam disk 27, and the receiving device 6, in the form of a blind bore with internal thread and provided for receiving the axle 15, can be clearly seen.

FIG. 3 shows a further feature which, on its own, possibly has an independent inventive quality: it can be seen that the viewing window 39 is inserted into a receptacle 40 of the housing 14, wherein the receptacle 40 is dimensioned and arranged such that the circuit board 21, which bears the magnetic field sensors 12, 13, 34, can be arranged directly behind the viewing window 39. Here, in particular, a depth of the receptacle 40 is in particular coordinated with a thickness of the viewing window 39. In this way, on the outer side, a step 43 is formed on the housing 14, which step forms a mechanical guard for the operator control device 2. Here, it is also advantageous that a single circuit board can be used, which bears both the magnetic field sensors 12, 13, 34 and the above-described display 19.

In summary, to improve the operator control capability of an actuating drive 1, it is provided that switches be dispensed with and, instead, at least two rotary elements 3, 4, that is to say actuating elements for rotational operator control, be arranged concentrically with respect to one another such that these can be operated using both hands and, in the process, are rotatable individually and independently of one another, preferably about a common axis of rotation 5. It is also provided that rotational adjustment movements of the two rotary elements 3, 4 be transmitted in each case by a magnetic coupling through a housing section, which is designed without apertures, of the actuating drive 1 into an interior space 10 of said actuating drive, such that, for reading out the magnetic fields, use can be made of conventional Hall sensors, and the housing 14 of the actuating drive 1 can be designed to be explosion-proof. This approach furthermore makes it possible, in the event of a failure of the rotary elements 3, 4, for example owing to icing, for the magnetic fields required for operator control to be transmitted into the interior space 10 by using a magnetic pin, such that high operational reliability can be ensured under all circumstances.

LIST OF REFERENCE DESIGNATIONS

1 Actuating drive
2 Operator control device
3 Inner rotary element
4 Outer rotary element
5 Axis of rotation
6 Receiving device
7 Recess
8 Mechanical lock
9 Equilibrium position
10 Interior space
11 Magnet
12 Magnetic field sensor of a first type
13 Magnetic field sensor of a second type
14 Housing (of the actuating drive)
15 Axle
16 Spring element
17 Bracing ramp
18 Detent mechanism
19 Display
20 Housing cover
21 Circuit board
22 Angle range
23 Detent lugs
24 Leaf spring
25 Helical spring
26 Stud
27 Cam disk
28 Support bearing
29 End (of the leaf spring)
30 Projection
31 Switchover point
32 End stop
33 Thread
34 Magnetic field sensor of a third type
35 Rim
36 Holding element
37 Driver
38 Passage window
39 Viewing window
40 Receptacle (of the housing)
41 Recess (of the housing)
42 Recess (for spring element)
43 Step

The invention claimed is:

1. An actuating drive (1) comprising:

an operator control device (2) for controlling the actuating drive (1), the operator control device (2) including:

an inner rotary element (3);

an outer rotary element (4);

the two rotary elements (3, 4) being arranged concentrically with respect to one another and being rotatable independently of one another about a common axis of rotation (5), wherein at least one of the rotary elements (3, 4) has at least one equilibrium position (9) that is haptically readable, the at least one of the rotary elements (3, 4) being movable out of the at least one equilibrium position (9) counter to a first restoring force, the at least one of the rotary elements (3, 4) being switchable over from the at least one equilibrium position (9) into an adjacent equilibrium position (9) counter to a second restoring force that is different from the first restoring force.

2. The actuating drive (1) as claimed in claim 1, wherein at least one of (a) the inner rotary element (3) protrudes axially beyond the outer rotary element (4); (b) the outer rotary element (4) protrudes radially beyond the inner rotary element (3); or (c) the operator control device (2) is mounted in a non-destructively removable manner on the actuating drive (1) via a receiving device (6) which defines the axis of rotation (5).

3. The actuating drive (1) as claimed in claim 1, wherein the inner rotary element (3) and the outer rotary element (4) are each held individually by an axle (15) that defines the axis of rotation (5), or the outer rotary element (4) is held axially by the inner rotary element (3).

4. The actuating drive (1) as claimed in claim 1, further comprising a mechanical lock (8), and at least one of the rotary elements (3, 4) has at least one recess (7) for receiving the mechanical lock (8) by which the respective rotary element (3, 4) is blockable.

5. The actuating drive (1) as claimed in claim 1, wherein an angle range (22) of at least +/−5° is provided for deflection movements of the at least one of the rotary element (3, 4) out of an equilibrium position (9), in said angle range (22) the at least one of the rotary elements (3, 4) is automatically returnable by one of the first or second restoring forces, into the equilibrium position (9) used as initial position, or adjacent ones of the equilibrium positions (9) of the at least one of the rotary elements (3, 4) are spaced apart from one another by at least 25°.

6. The actuating drive (1) as claimed in claim 1, further comprising a magnetic coupling by which a control command input by at least one of the inner rotary element (3) or the outer rotary element (4) is transmittable in contactless fashion into an interior space (10) of the actuating drive (1).

7. The actuating drive (1) as claimed in claim 1, further comprising a spring element (16) that generates a restoring force during a deflection or switchover of at least one of the rotary elements (3, 4), a rate of a rise of the restoring force increasing with the deflection of the at least one of the rotary elements (3, 4) out of an equilibrium position (9), with different gradients being provided on a bracing ramp (17), with which different gradients the spring element (16) interacts for an increase of a rate of rise of the restoring force.

8. The actuating drive (1) as claimed in claim 7, further comprising a detent mechanism (18) that provides an engagement, which can be read out haptically, of at least one of the rotary elements (3, 4) in at least one of the equilibrium positions (9), and the spring element (16) is designed for the engagement in the equilibrium position (9).

9. The actuating drive (1) as claimed in claim 7, wherein the spring element (16) is a leaf spring (24), and the leaf spring (24) is held in a region of both of ends (29) thereof by the at least one of the rotary elements (3, 4), such that at least one of: (a) the leaf spring (24) is pivotable about support bearings (28) spaced apart from the ends (29) thereof, (b) the ends (29) of the leaf spring (24) are movable, or (c) the leaf spring (24) is M-shaped; or the actuating device further comprises a cam disk (27) with a sequence of different inclines in order, in interaction with the spring element (16) to generate restoring forces of different intensity, the spring (24) forming a projection (30) for engagement into at least one corresponding recess (31) of the cam disk (27), and the cam disk (27) including end stops (32) for a rotational limitation of the operator control movements of the at least one of the rotary elements (3, 4).

10. The actuating drive (1) as claimed in claim 9, wherein the operator control device (2) is fastenable or fastened by the cam disk (27) to the housing (14) of the actuating drive (1), the cam disk (27) for being connected or connectable to the housing (14) in punctiform fashion against the housing (14), and the cam disk (27) including an encircling rim (35).

11. The actuating drive (1) as claimed in claim 10, wherein the inner rotary element (3), bears at least one of the magnets (11), and is guided through a passage window (38) in at least one of the outer rotary element (4) or the cam disk (27) to the housing (14) of the actuating drive (1).

12. The actuating drive (1) as claimed in claim 1, wherein the second restoring force is greater than the first restoring force.

13. The actuating drive (1) as claimed in claim 1, wherein a switching over between adjacent equilibrium positions is distinguished from a deflection out of the at least one equilibrium position in a rocking operator control due to the second restoring force being greater than the first restoring force.

14. An actuating drive (1) having an operator control device (2) for controlling the actuating drive (1), the operator control device comprising:

magnetic field sensors (12, 13) in an interior space (10) of a housing of the actuating drive (1); and a device for changing the operator control device (2) over from manual operator control to pin-based operator control, wherein an arrangement of the magnetic field sensors (12, 13) is marked on an outer side of the housing of the actuating drive to identify areas adapted for actuation by an external magnet.

15. A method (1) for operator control of an actuating drive (1), the method comprising:

providing the actuating drive (1) with an operator control device (2) having two rotary elements (3, 4);

an operator inputting control commands required for operation of the actuating drive (1) via the rotary elements (3, 4) with the operator performing movements of the two rotary elements at least one of partially simultaneously, in parallel, or using two hands; and wherein at least one of the rotary elements (3, 4) has at least one equilibrium position (9) that is haptically readable, the at least one of the rotary elements (3, 4) being movable out of the at least one equilibrium position (9) counter to a first restoring force, the at least one of the rotary elements (3, 4) being switchable over from the at least one equilibrium position (9) into an adjacent equilibrium position (9) counter to a second restoring force that is different than the first restoring force.

16. A method (1) for operator control of an actuating drive (1), comprising:

providing the actuating drive (1) with an operator control device (2) including at least one rotary element (3, 4) for generating control commands; and contactlessly transmitting all of the control commands required for operation of the actuating drive (1) through a housing (14) into an interior space (10) of the actuating drive (1), wherein control commands are transmitted to the actuating drive (1) by rotating the at least one rotary element (3, 4) from a first equilibrium position (9) into an adjacent equilibrium position (9) and by deflecting the at least one rotary element (3, 4) out of the equilibrium position (9) as far as defined switchover points (31), the equilibrium positions (9) and the switchover points (31) being read out haptically, and the at least one rotary element (3, 4) being held in the equilibrium positions (9) by a detent mechanism (18), and the at least one of the rotary elements (3, 4) being movable out of the at least one equilibrium position (9) counter to a first restoring force, the at least one of the rotary elements (3, 4) being switchable over from the at least one equilibrium position (9) into an adjacent equilibrium position (9) counter to a second restoring force that is different than the first restoring force.

17. An actuating drive (1) having an operator control device (2) for controlling the actuating drive (1), the operator control device (2) comprising:

a rotary element (3, 4) which has at least one magnet (11) for transmitting operator control movements into an interior space (10) of the actuating drive, magnetic field sensors (12, 13) that read out operator control movements of the rotary element (3, 4) in an interior space of the operator control device, the at least one magnet (11) being arranged radially at an outside or facing a housing (14) of the actuating drive (1), in or on the rotary element (3, 4), and the rotary element (3, 4) has at least one equilibrium position (9) that is haptically readable, the rotary element (3, 4) being movable out of the at least one equilibrium position (9) counter to a first restoring force, the rotary element (3, 4) being switchable over from the at least one equilibrium position (9) into an adjacent equilibrium position (9) counter to a second restoring force that is different from the first restoring force.

18. The actuating drive (1) as claimed in claim 17, wherein each said equilibrium position (9) of the at least one of the rotary elements (3, 4) is assigned a pair comprised of one of the magnets (11) held by the at least one of the rotary elements (3, 4) and a magnetic field sensor of a first type (12) arranged in the desired equilibrium position (9) within a housing (14) of the actuating drive (1), the one of the magnets (11) held by the at least one of the rotary elements (3, 4) being assigned to all equilibrium positions (9) of the at least one of the rotary elements (3, 4), and at least one of a further magnetic field sensor of a second type (13) or a further magnet (11) to detect a direction of rotation of the at least one of the rotary elements (3, 4) upon movement out of an equilibrium position (9).

19. The actuating drive (1) as claimed in claim 18, wherein at least one of: (a) the magnetic field sensors of the first type (12) are, for detection of the equilibrium positions (9), arranged so as to be spaced apart from one another such that magnetic field detection regions thereof do not overlap, or (b) each said equilibrium position (9) of the at least one of the rotary elements (3, 4), is assigned two magnetic field sensors of the second type (13), which are each designed for detecting a deflection out of the respective equilibrium position (9) in each case in one direction.

20. The actuating drive (1) as claimed in claim 17, wherein at least two of the magnets (11) are formed on at least one of the rotary elements (3, 4), one of the at least two magnets (11) interacting with magnetic field sensors of a first type (12) arranged in the desired equilibrium position (9) within a housing (14) of the actuating drive (1), in order to detect the equilibrium positions (9) and a further magnet (11) of the at least two magnets (11) interacting with magnetic field sensors of a second type (13) in order to detect deflections of the rotary element (3, 4) out of an equilibrium position (9), the magnetic field sensors of the first type (12) being spaced apart from the magnetic field sensors of the second type (13) such that magnetic field detection regions thereof do not overlap.

21. The actuating drive (1) as claimed in claim 20, wherein, for N equilibrium positions (9) of the at least one of the rotary elements (3, 4), there are provided in each case N of the magnetic field sensors of the first type (12) for the detection of the equilibrium positions (9), or N+1 of the further magnetic field sensors of the second type (13) for the detection of operator control movements of the rotary element (3, 4), or both.

* * * * *